US009539706B2

(12) United States Patent
Ng

(10) Patent No.: US 9,539,706 B2
(45) Date of Patent: Jan. 10, 2017

(54) APPARATUS AND METHOD FOR USE IN MAKING LIGHT FILTERING WINDOW SHADES

(71) Applicant: Philip Ng, Thornhill (CA)

(72) Inventor: Philip Ng, Thornhill (CA)

(73) Assignee: ZMC Metal Coating Inc., Woodbridge, Ontario (CA)

( * ) Notice: Subject to any disclaimer, the term of this patent is extended or adjusted under 35 U.S.C. 154(b) by 358 days.

(21) Appl. No.: 14/193,637

(22) Filed: Feb. 28, 2014

(65) Prior Publication Data

US 2014/0331469 A1 Nov. 13, 2014

Related U.S. Application Data

(60) Provisional application No. 61/820,908, filed on May 8, 2013.

(51) Int. Cl.
*B25B 11/02* (2006.01)
*B25H 1/02* (2006.01)

(52) U.S. Cl.
CPC ..... *B25B 11/02* (2013.01); *B25H 1/02* (2013.01); *Y10T 29/49826* (2015.01); *Y10T 29/53961* (2015.01)

(58) Field of Classification Search
CPC ..... B23P 19/04; B23P 19/10; B23Q 3/06; B25B 11/02
See application file for complete search history.

(56) References Cited

U.S. PATENT DOCUMENTS 5,673,843 A * 10/1997 Gainey ..... B23K 37/0533 228/44.5
6,571,448 B2 * 6/2003 Lee ..... B24B 29/02 269/289 R
6,860,800 B1 * 3/2005 Maurer ..... B23Q 7/02 269/289 MR
2014/0084530 A1 * 3/2014 Hodges ..... B60B 30/00 269/296

* cited by examiner

*Primary Examiner* — Lee D Wilson
(74) *Attorney, Agent, or Firm* — Honigman Miller Schwartz and Cohn LLP

(57) ABSTRACT

An apparatus to aid in the making of a light filtering window shade from shade fabric comprised of a series of longitudinal vane members having their longitudinal edges respectively secured to front and rear fabric panels. The apparatus comprises an assembly table and a roller tube positioning rail. The table has first and second ends with the first end adapted to facilitate the cutting of the shade fabric to a desired length. The roller tube positioning rail is releasably securable to the assembly table and releasably receives a roller tube having one end of the shade fabric secured thereto. The positioning rail permits the roller tube, and the shade fabric secured thereto, to be set-off a predetermined distance from the first end of the assembly table. The positioning rail maintains the roller tube generally parallel to the first end of the assembly table.

9 Claims, 23 Drawing Sheets

APPARATUS AND METHOD FOR USE IN MAKING LIGHT FILTERING WINDOW SHADES

RELATED APPLICATION

This application claims the benefit of U.S. provisional patent application Ser. No. 61/820,908 filed on May 8, 2013.

FIELD

This invention relates to an apparatus and a method for use in the making of light filtering window shades.

BACKGROUND

Window shades, or window blinds as they are sometimes referred to, are commonly mounted on windows for privacy purposes and to limit light intrusion. With advances in technology and increased functionality, window shades have displaced a significant portion of the more traditional drapery market and are commonly used in both residential and commercial applications. One particular form of shade that has experienced increased popularity is referred to generically as a light filtering shade. In general, light filtering shades are comprised of a series of vanes (typically horizontally mounted) having their longitudinal edges adhered to a pair of generally parallel sheer fabric layers. Typically the vanes are constructed from an opaque material so that they can provide a room darkening effect.

Light filtering shades of the nature described above operate on the principle of moving the vanes between a position where individual vanes lie in generally parallel horizontal planes (wherein they have little light filtering or room-darkening effect) to a position wherein the vanes are generally vertically oriented, and preferably slightly overlapping along their longitudinal edges (wherein they provide a light filtering or room darkening function). The activation of the vanes is accomplished through the operation of clutch and a drive mechanism that is operatively connected to a roller tube to which the shade fabric is secured. The structure and operation of such clutch and drive mechanisms will be commonly understood by those of skill in the art. Light filtering window shades provide a light filtering or room-darkening effect, while presenting the overall visual appearance of a traditional horizontal window blind or shade.

With increasing popularity and demand for light filtering window shades, there is a need for new and innovative devices and methods to assist in their manufacturing. Current manufacturing devices and methods tend to be complex and cumbersome.

SUMMARY

The invention therefore provides an apparatus to aid in the making of a light filtering window shade from shade fabric comprised of a series of longitudinal vane members having their longitudinal edges respectively secured to front and rear fabric panels, the apparatus comprising an assembly table, said assembly table having first and second ends with said first end adapted to facilitate the cutting of the shade fabric to a desired length; and a roller tube positioning rail releasably securable to the assembly table, said positioning rail releasably receiving a roller tube having one end of the shade fabric secured thereto, said positioning rail permitting the roller tube, and the shade fabric secured thereto, to be set-off a predetermined distance from said first end of said assembly table, said positioning rail maintaining the roller tube generally parallel to said first end of said assembly table.

There is also provided apparatus to aid in the making of a light filtering window shade from shade fabric comprised of a series of longitudinal vane members having their longitudinal edges respectively secured to front and rear fabric panels, the apparatus comprising an assembly table, said assembly table having first and second ends with said first end adapted to facilitate the cutting of the shade fabric to a desired length; a roller tube positioning rail releasably securable to the assembly table, said positioning rail releasably receiving a roller tube having one end of the shade fabric secured thereto, said positioning rail permitting the roller tube, and the shade fabric secured thereto, to be set-off a predetermined distance from said first end of said assembly table, said positioning rail maintaining the roller tube generally parallel to said first end of said assembly table, said roller tube positioning rail including a first roller tube clamp and a second roller tube clamp, said first and second roller tube clamps engaging the roller tube and releasably securing the roller tube to said positioning rail; and a cutting rail positioned at said first end of said assembly table, said cutting rail positioned generally parallel to said roller tube positioning rail when said positioning rail is releasably secured to said assembly table, said cutting rail permitting shade fabric attached to a roller tube releasably secured to said roller tube positioning rail to be cut to a desired length such that the cut edge of the fabric is generally parallel to the roller tube There is further provided a method of making a light filtering window shade from shade fabric comprised of a series of longitudinal vane members having their longitudinal edges respectively secured to front and rear panels, said front and rear panels each having top and bottom edges, the method comprising securing the top edges of the front and rear panels to opposite sides of a roller tube; securing the roller tube to a roller tube positioning rail releasably securable to an assembly table, the assembly table having a first end, said first end adapted for cutting the shade fabric to a desired length; locating said roller tube positioning rail, having said roller tube secured thereto, upon said assembly table at a desired distance from said first end and releasably securing said roller tube positioning rail to said assembly table at said desired distance; at said first end of said assembly table, cutting the shade fabric to a desired length; placing a bottom bar for the light filtering window shade within a bottom bar holder at said first end of said assembly table and securing the cut end of the shade fabric to the bottom bar.

Further aspects will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show exemplary embodiments of the present invention in which.

DESCRIPTION

The present invention may be embodied in a number of different forms. The specification and drawings that follow describe and disclose some of the specific forms of the invention.

Figure 1:
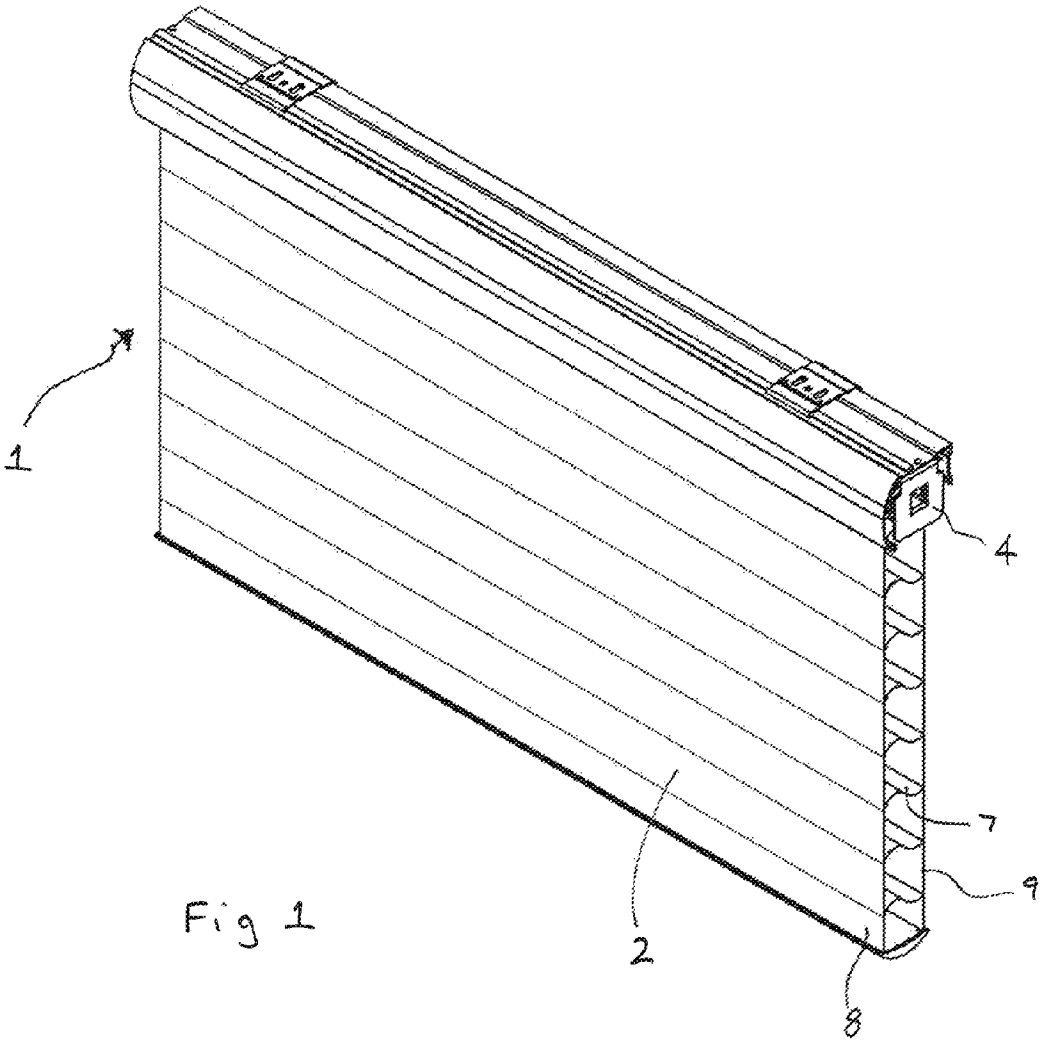
FIG. 1 is a side perspective view of a typical light filtering window shade.
Figure 2:
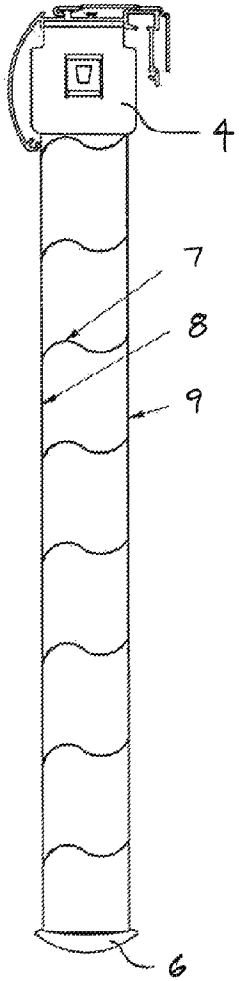
FIG. 2 is a side view of the window shade shown in FIG. 1.
Figure 3:
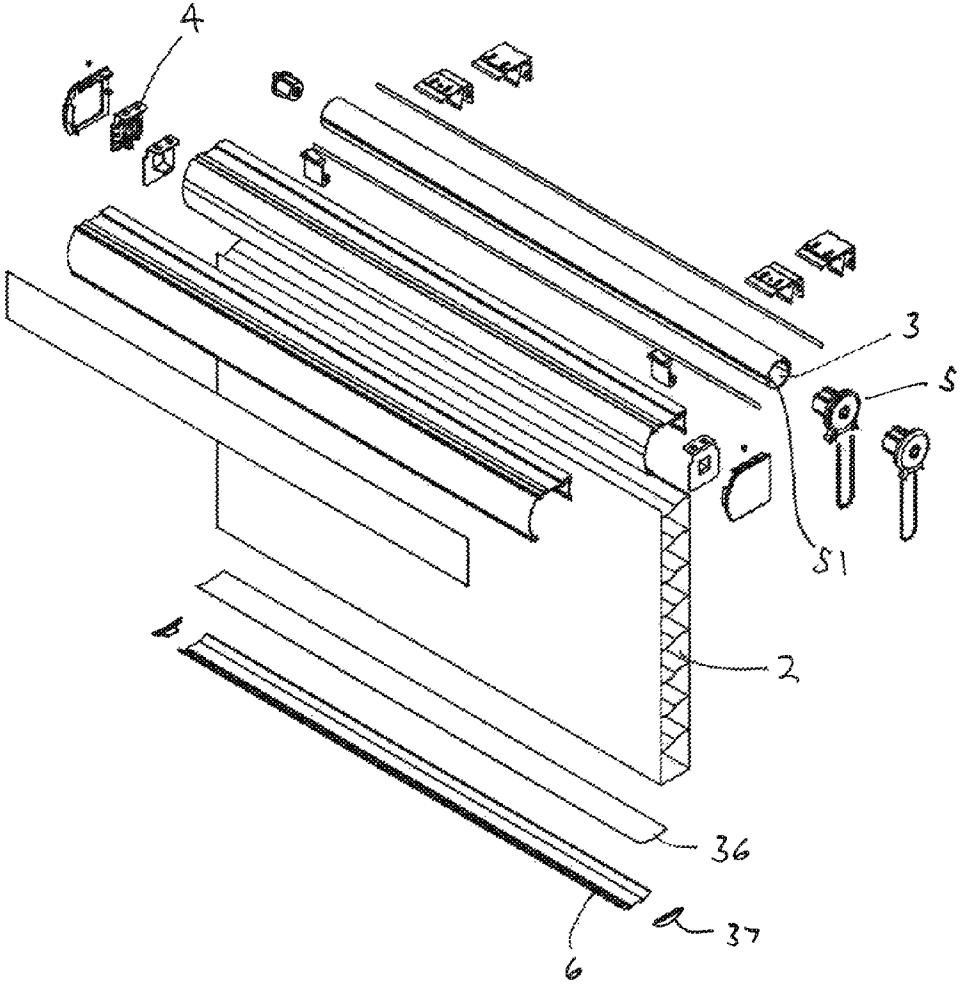
FIG. 3 is an exploded view of the window shade shown in FIG. 1.

Referring to attached FIGS. 1 through 3, there is shown an example of a light filtering window shade 1 as is commonly used in both residential and commercial applications. Although many of the components of the fully assembled shade are not specifically relevant to the present invention, for illustration purposes, both an assembled and an exploded shade are shown. In the embodiment depicted in the attached Figures, the shade includes a shade fabric 2 which is mounted to a roller tube 3 held and positioned between pair of end brackets 4. A clutch and drive mechanism 5 is utilized to rotate the roller tube, causing the shade to "open" or "close", or alternatively lifting or lowering the shade fabric by winding or unwinding it around the exterior of the roller tube. A bottom bar 6 would typically be fastened to the lower edge of the shade fabric. Shade fabric 2 is comprised of a series of longitudinal vane members 7 that are secured to a front panel 8 and a rear panel 9 along their edges. Commonly, the vane members will be generally "S"-shaped in cross-section, would be parallel to one another and spaced apart equally along the length of the shade fabric. The vane members would also typically be parallel to the roller tube such that when the roller tube is fixed in a horizontal position, the vane members are also horizontal. Since such light filtering window shades are in common use, one of ordinary skill will appreciate that rotation of the roller tube can result in the vanes being positioned in their generally horizontal plane (wherein they allow for the transmission of light through the shade) to an inclined position (wherein they decrease the amount of light allowed to pass through the shade), to a position where the vanes are essentially in a vertical plane (wherein they largely prohibit the transmission of light through the shade). In most instances front and rear panels 8 and 9 would be of a relatively sheer nature such that they would not significantly block the intrusion of light into a room.

Figure 4:
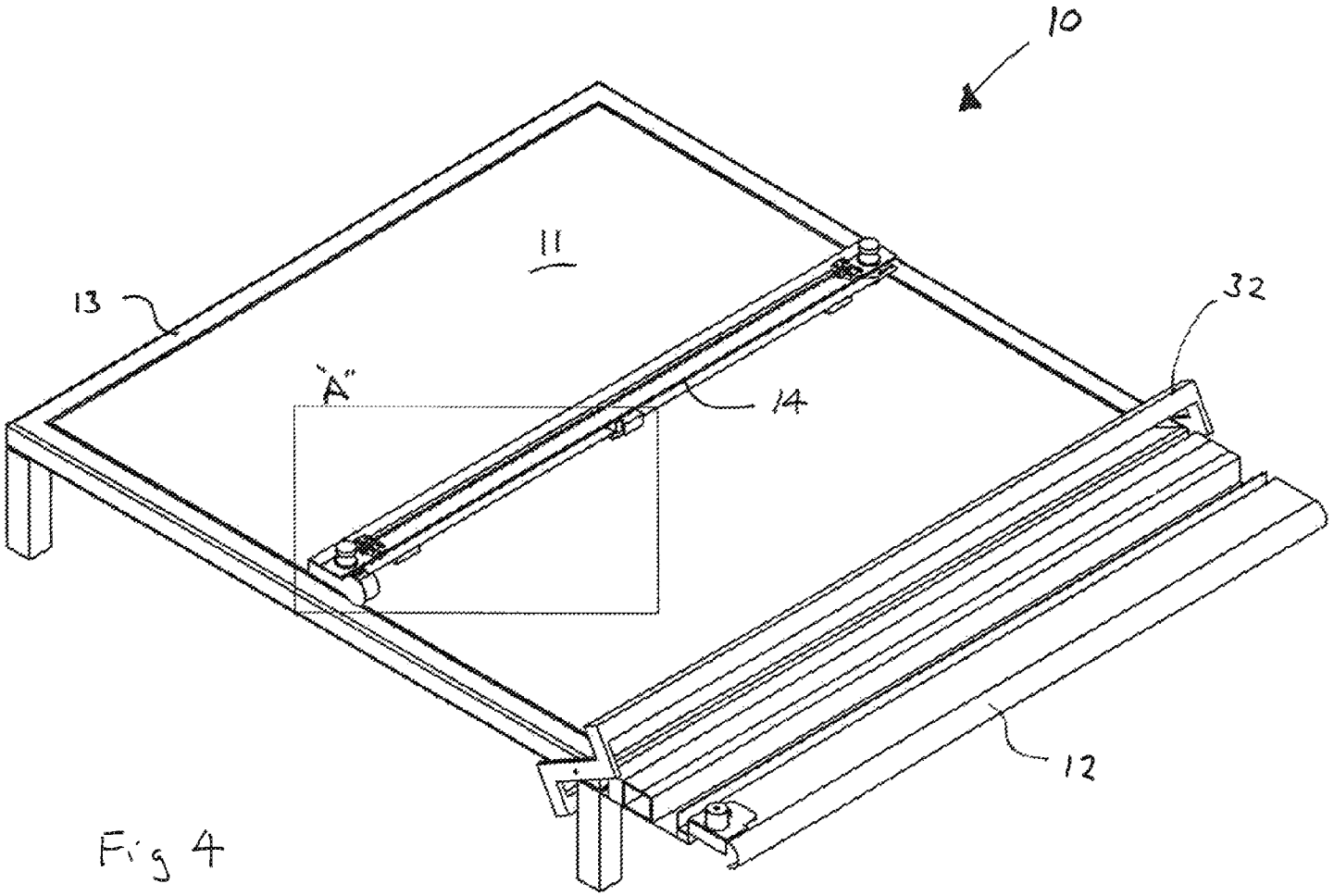
FIG. 4 is an upper side perspective view of an assembly table.
Figure 5:
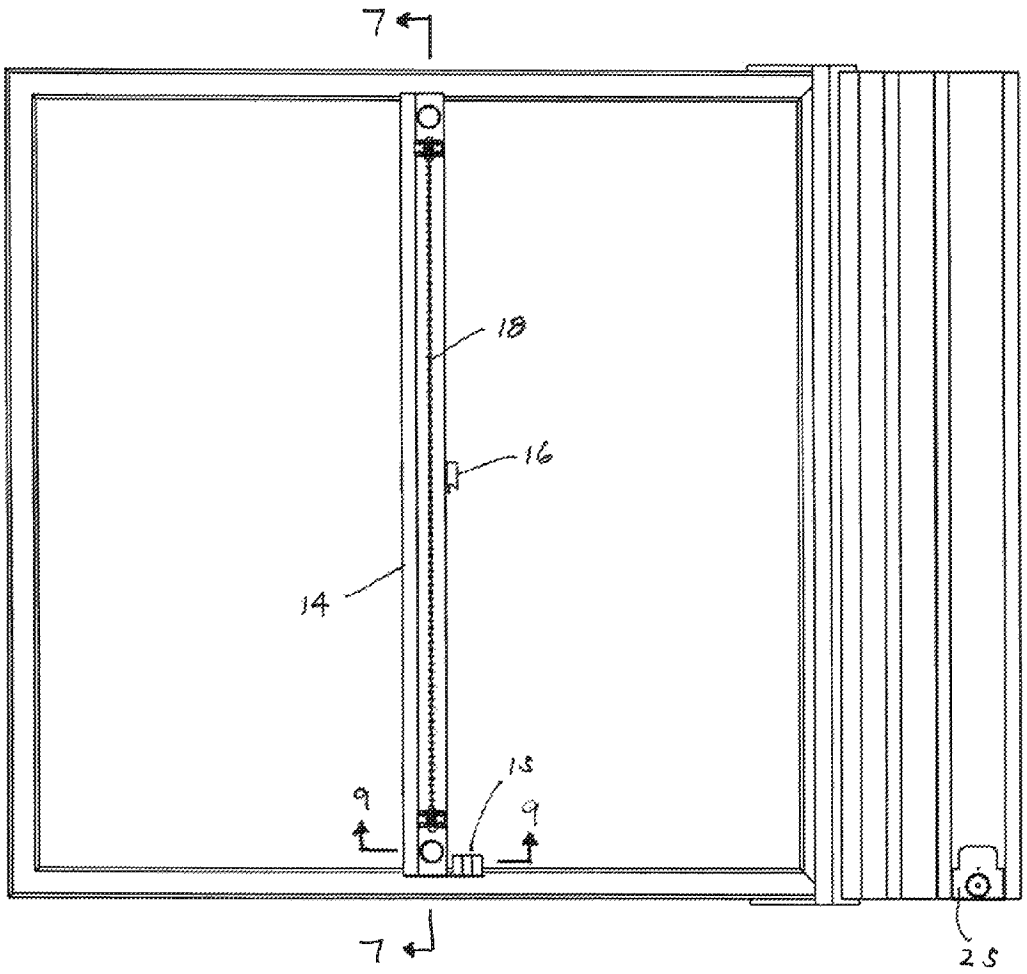
FIG. 5 is a plan view of the assembly table shown in FIG. 4.

Referring next to FIG. 4, there is shown an embodiment of an apparatus 10 that aids in the making of a light filtering window shade. Apparatus 10 is comprised generally of an assembly table 11 (that in this instance is shown to be rectangular) having a first end 12 and a second end 13. As will become more apparent below, first end 12 is adapted to facilitate the cutting of shade fabric 2 to a desired length. A roller tube positioning rail 14 is releasably securable to assembly table 11. Positioning rail 14 releasably receives a roller tube 3 having one end of the shade fabric secured thereto. Releasably securing the positioning rail along the longitudinal axis of assembly table 11 permits the roller tube, and the shade fabric, to be set-off a predetermined distance from first end 12. Rail 14 retains the roller tube generally parallel to the first end of the assembly table.

Figure 6:
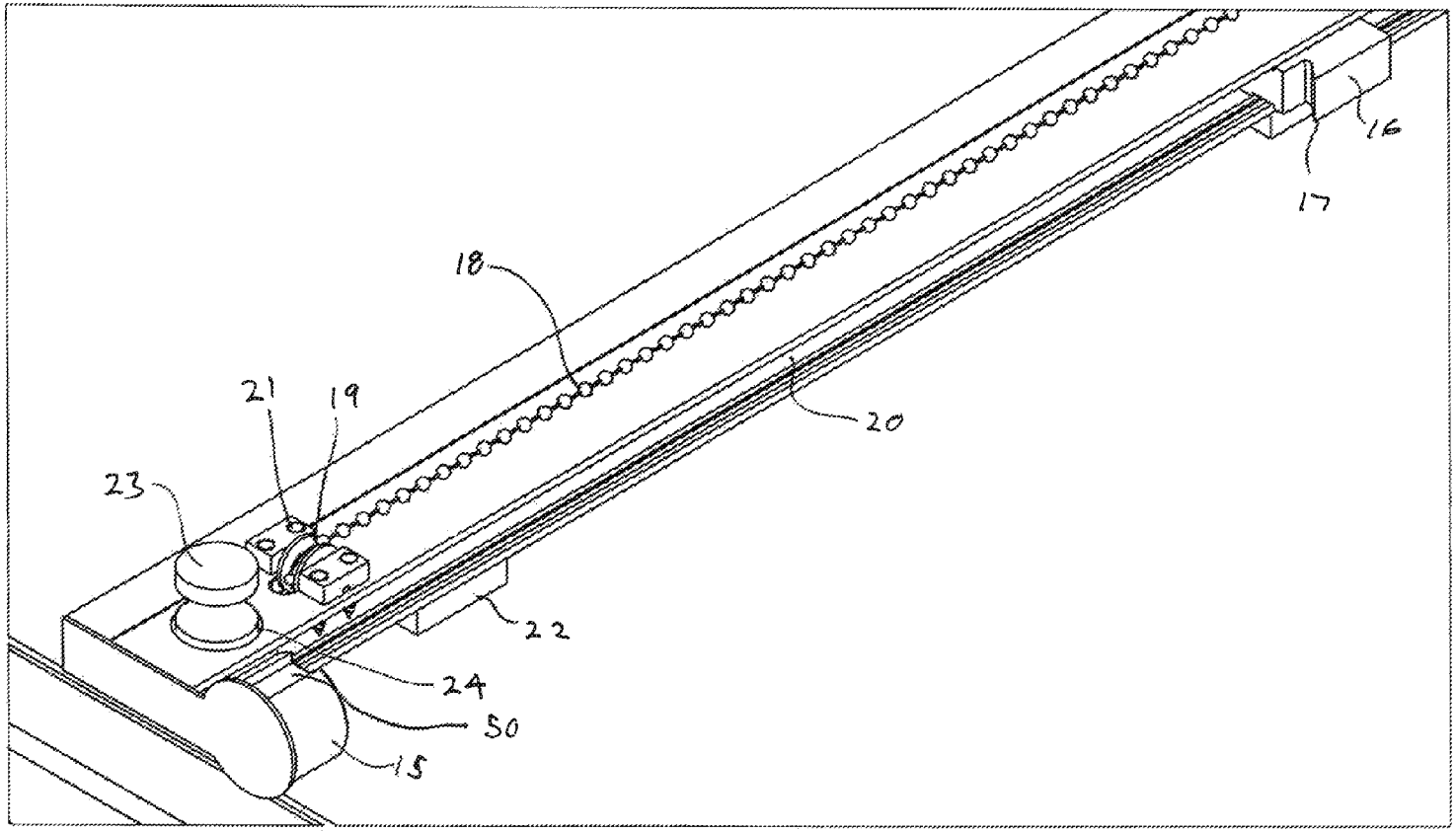
FIG. 6 is an enlarged detail view of portion "A" of FIG. 4.
Figure 7:
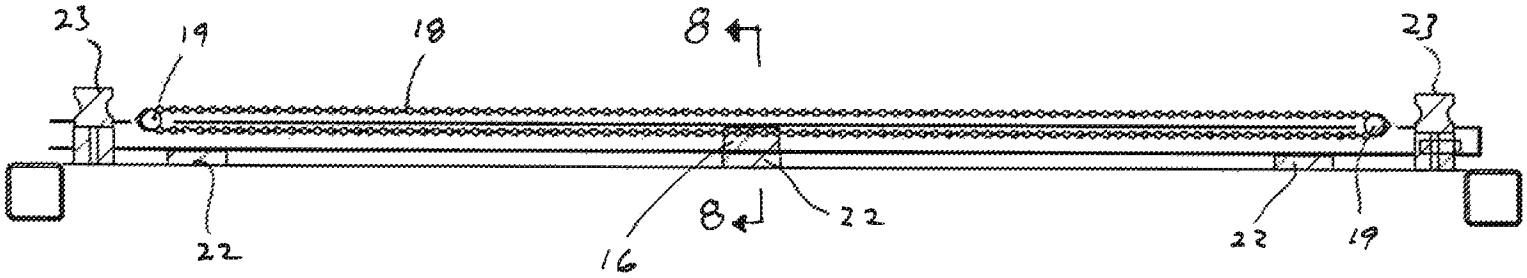
FIG. 7 is a vertical sectional view taken along the line 7-7 of FIG. 5.
Figure 8:
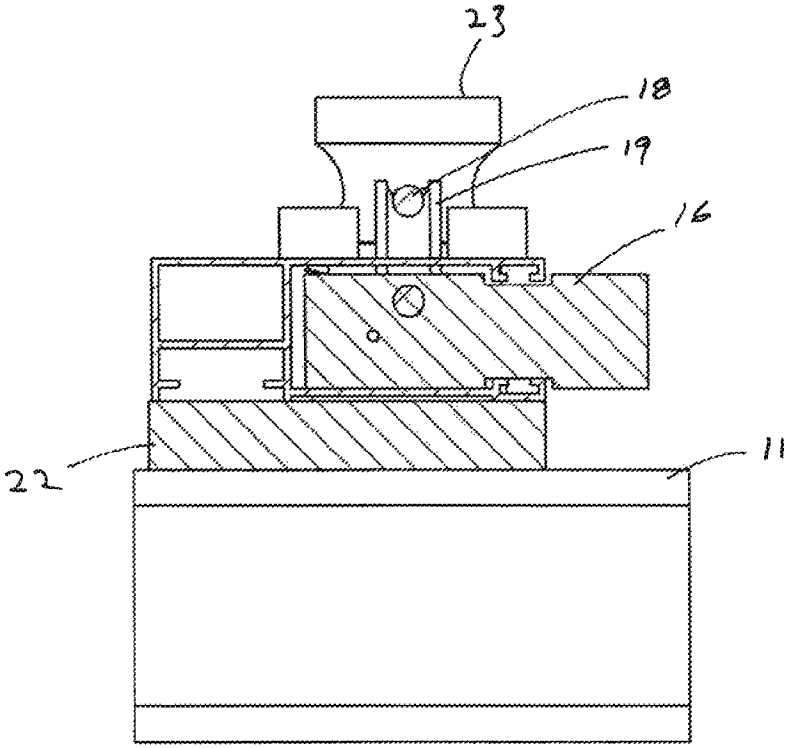
FIG. 8 is a vertical sectional view taken along the line 8-8 of FIG. 7.
Figure 9:
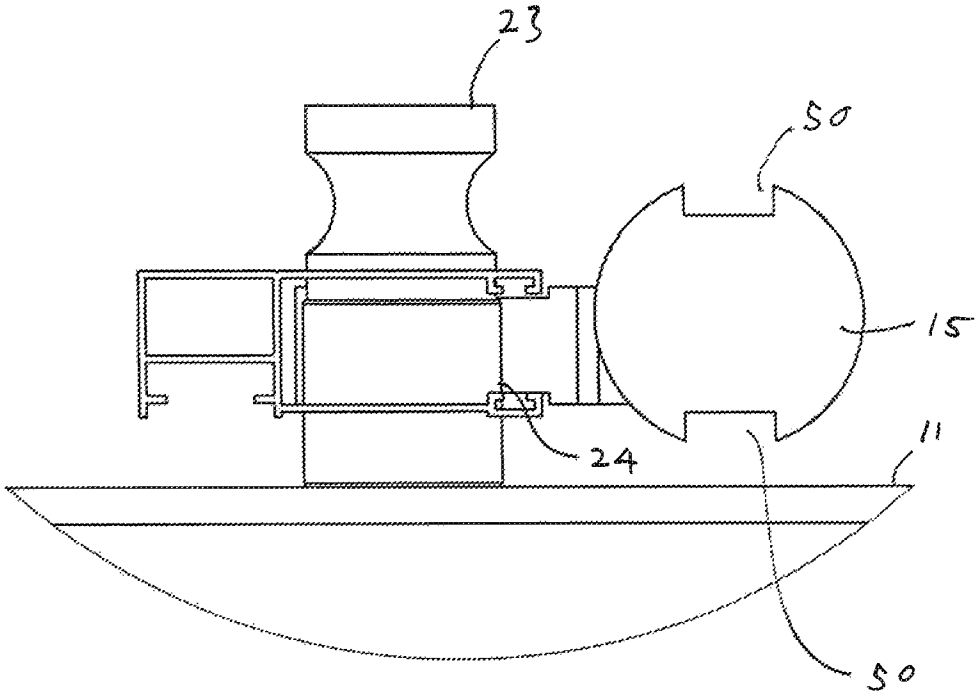
FIG. 9 is a sectional view taken along the line 9-9 of FIG. 5.

Roller tube positioning rail 14 includes a first roller tube clamp 15 and a second roller tube clamp 16. Together, first and second tube clamps 15 and 16 engage the roller tube and releasably secure the roller tube to the positioning rail. To that end, in one embodiment of the invention at least one of the roller tube clamps is adjustable along the length of the roller tube positioning rail so as to permit roller tubes of varying lengths to be releasably secured to the positioning rail. With reference specifically to FIG. 6, first roller tube clamp 15 is fixed in position relative to the positioning rail. In this embodiment clamp 15 is generally cylindrical in nature and sized to be received within the hollow end of the roller tube. Further, clamp 15 includes a pair of longitudinal channels 50 that receive interior ribs 51 on the inside diameter of the roller tube such that when the roller tube is releasably secured to roller tube clamp 15 the roller tube is prevented from rotating about its longitudinal axis. Other means to prevent rotational movement of the roller tube could equally be employed.

Referring again to FIG. 6, in the embodiment shown, second roller tube clamp 16 is generally in the form of a hook that has a bill 17 to be received within the interior of one end of the roller tube. A chain 18 runs the length of roller tube positioning rail 14 and is received around a pulley or sprocket 19 located at each end of the rail. A portion of the chain is also fixed to second roller clamp 16. Clamp 16 is received within a channel 20 along the front edge of the positioning rail. A chain drive mechanism 21 (which in this case represents the upper surface of one or both of the pulleys or sprockets 19) permits the rotational movement of the chain about pulleys or sprockets 19, having the effect of sliding second roller tube clamp 16 in one direction or the other along channel 20. Accordingly, with one end of the roller tube received about first roller tube clamp 15, chain 18 can be rotated to "draw" second roller tube clamp 16 toward the opposite end of the roller tube until such time as bill 17 on the hook of clamp 16 engages the end of the roller tube, securely holding it in place. At that point, the chain will preferably be tensioned and locked in position until such time as there is a desire to remove the roller tube from the pair of roller tube clamps. It will be appreciated that locking the chain in place can be achieved through a wide variety of different mechanical structures. It will also be appreciated that although a chain and pair of pulleys or sprockets is depicted in the attached drawings, chain 18 could be replaced by a belt, a servo motor drive system, a magnetic drive system, a pneumatic system or a hydraulic system. In yet a further alternate embodiment, positioning rail 14 could have located on it mechanical fasteners at specific locations that will engage second roller tube clamp 16 when roller tubes of a desired and predetermined length are mounted to first roller tube clamp 15. To help support the weight of positioning rail 14 and a roller tube that may be secured thereto, the positioning rail may include one or more feet 22 extending from the lower surface of the rail to the upper surface of the assembly table.

As discussed, roller tube positioning rail 14 serves the purpose of releasably securing a roller tube, with shade fabric fastened thereto, to the assembly table. The roller tube is held parallel to first end 12 of the assembly table and a predetermined distance therefrom. The functionality of the roller tube positioning rail can be accomplished in a variety of different ways. In the attached drawings, the roller tube positioning rail is releasably secured to assembly table 11 through the use of one or more magnets 23. With reference to FIGS. 5 through 10, roller tube positioning rail 14 includes two magnets 23, one located at each end of the positioning rail. Since in most instances the assembly table, or at least its upper surface, will be a steel or a steel alloy, magnets 23 will allow the positioning rail to be easily and quickly secured to the assembly table, yet at the same time permit the location of the rail upon the table to be adjusted as required. To facilitate the interaction of magnets 23 with assembly table 11, roller tube positioning rail 14 may be fitted with openings 24 at either end that allow the magnets to fully pass therethrough. Further, in such an embodiment it is expected that the positioning rail will be formed from an extruded aluminum or similar non-ferrous material so as to not directly interact with magnets 23.

From a thorough understanding of the invention one of ordinary skill in the art will appreciate that there are a wide variety of other mechanisms that could be utilized to releasably secure roller tube positioning rail 14 to assembly table 11. For example, but without limiting the foregoing, the assembly table could include longitudinal channels or tracks into which rollers or a portion of the positioning rail are received in order to allow the rail to effectively be slid along the upper surface of the table within the channels or tracks. Further, a more elaborate servo or hydraulic drive system could be utilized, as well as a mechanical clamp to secure the rail in place upon the upper surface of the table. Where magnets 23 are utilized, the magnets could be permanent magnets or electro-magnets.

Figure 11:
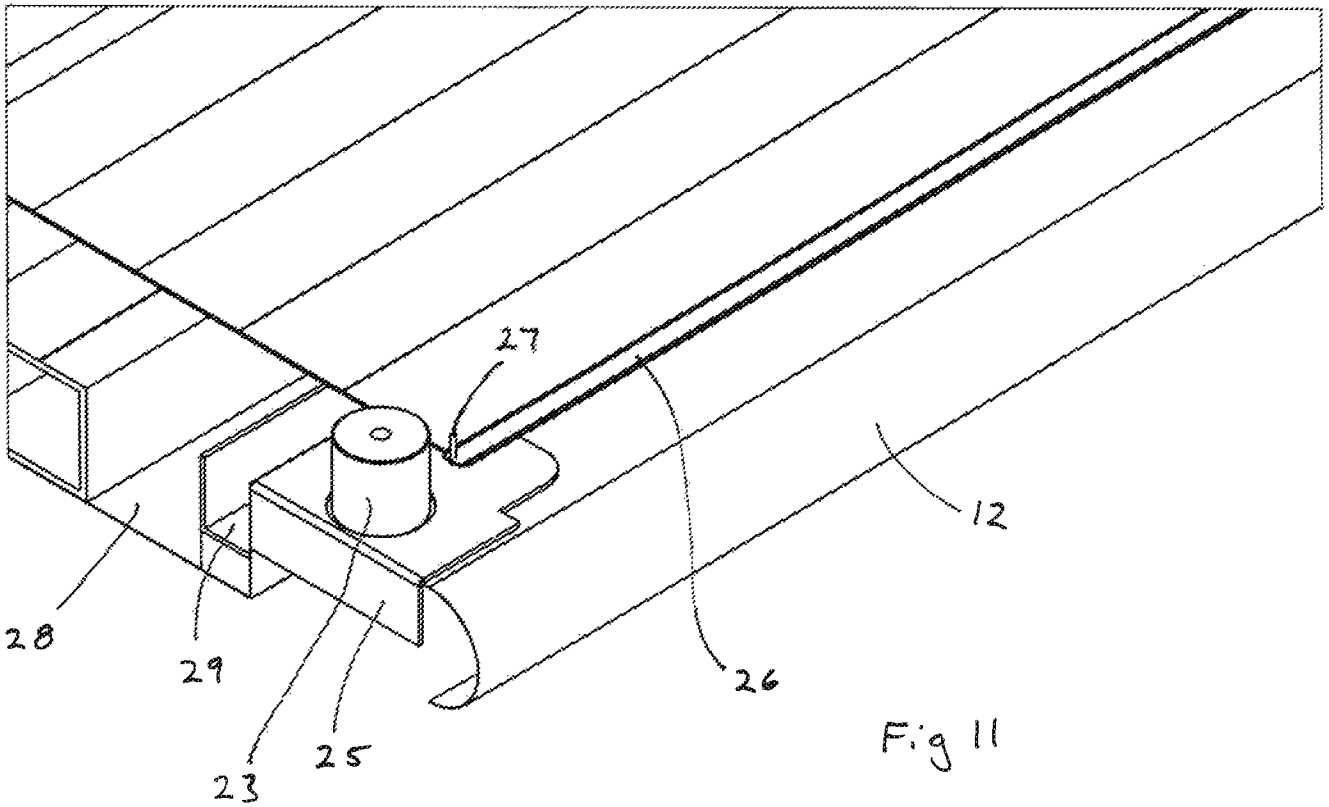
FIG. 11 is an enlarged view of portion "A" of FIG. 10.
Figure 12:
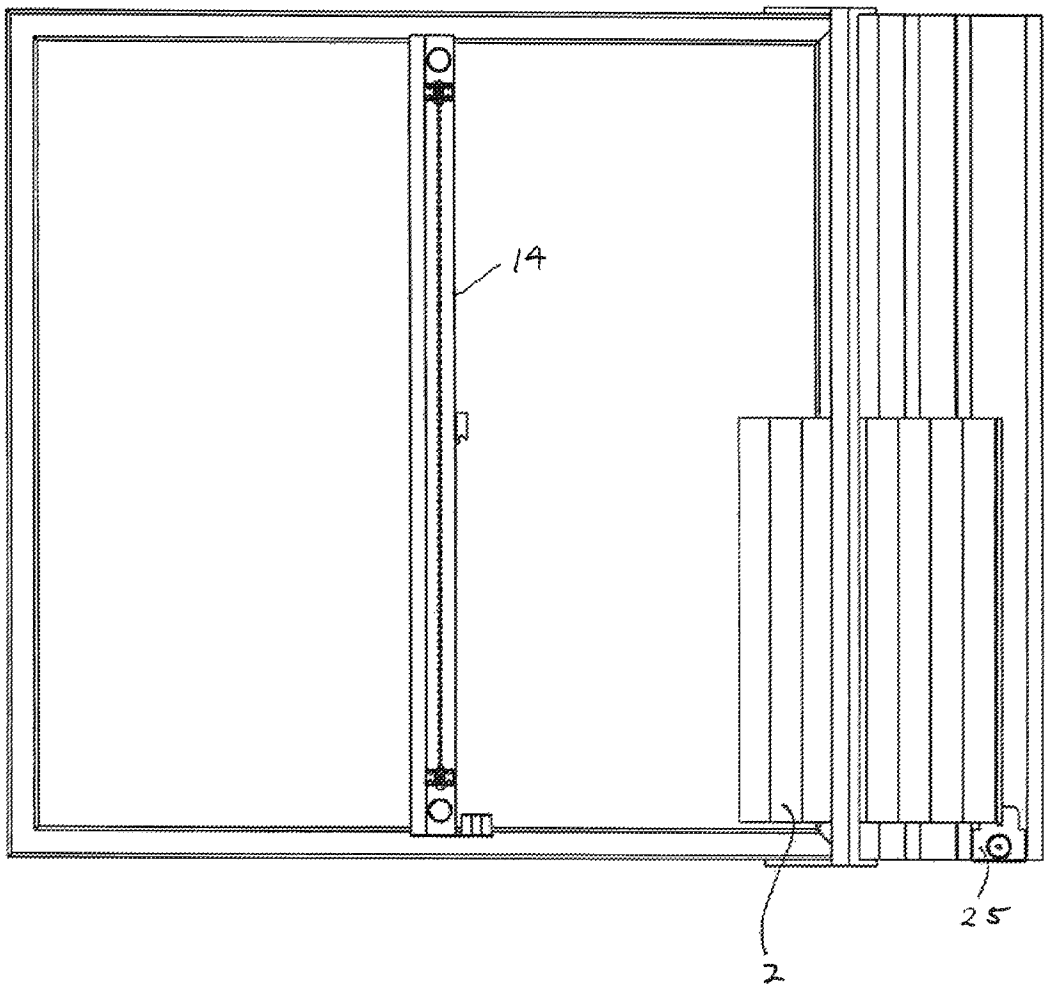
FIG. 12 is a plan view of the assembly table shown in FIG. 10.
Figure 13:
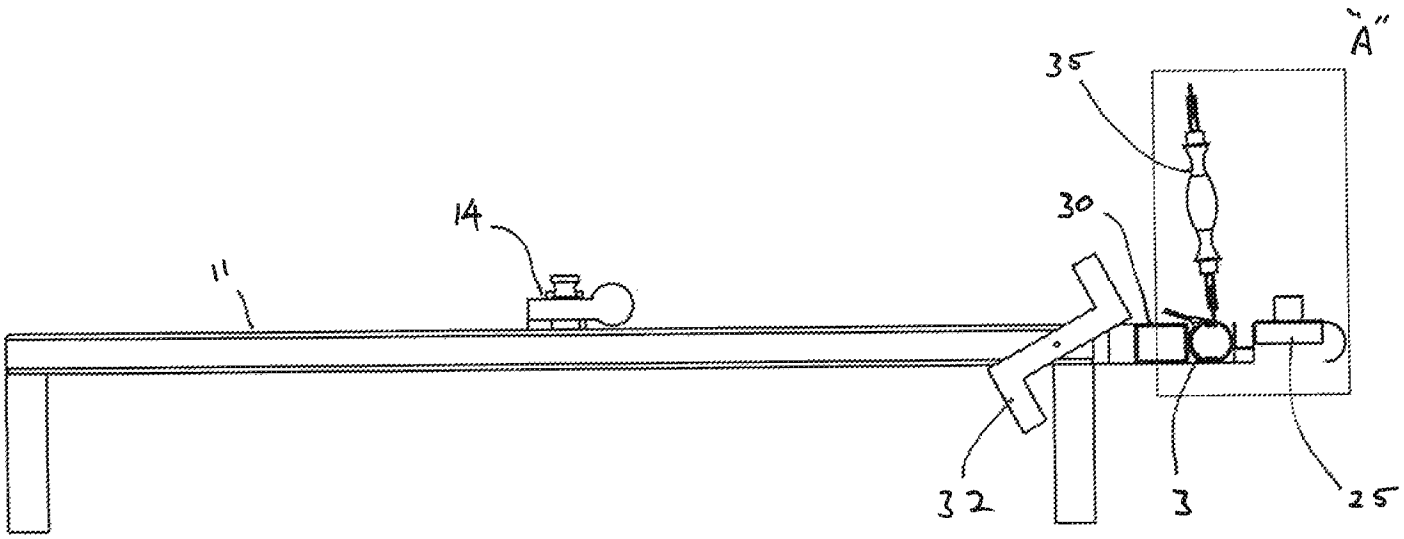
FIG. 13 is a side view of the assembly table showing the attachment of the shade fabric to the shade's roller tube.
Figure 14:
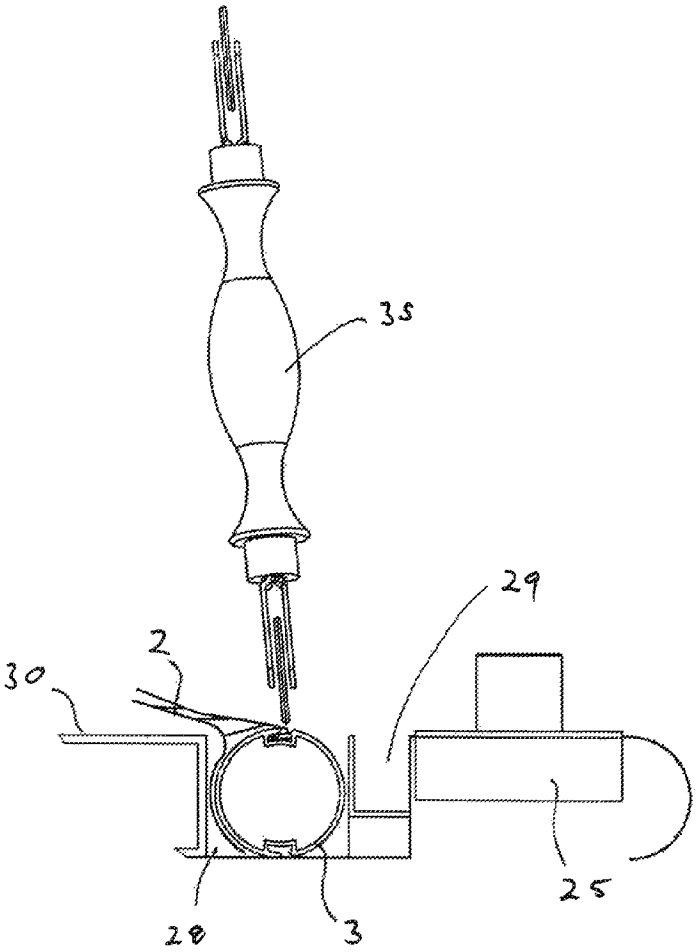
FIG. 14 is an enlarged view of portion "A" of FIG. 13.
Figure 15:
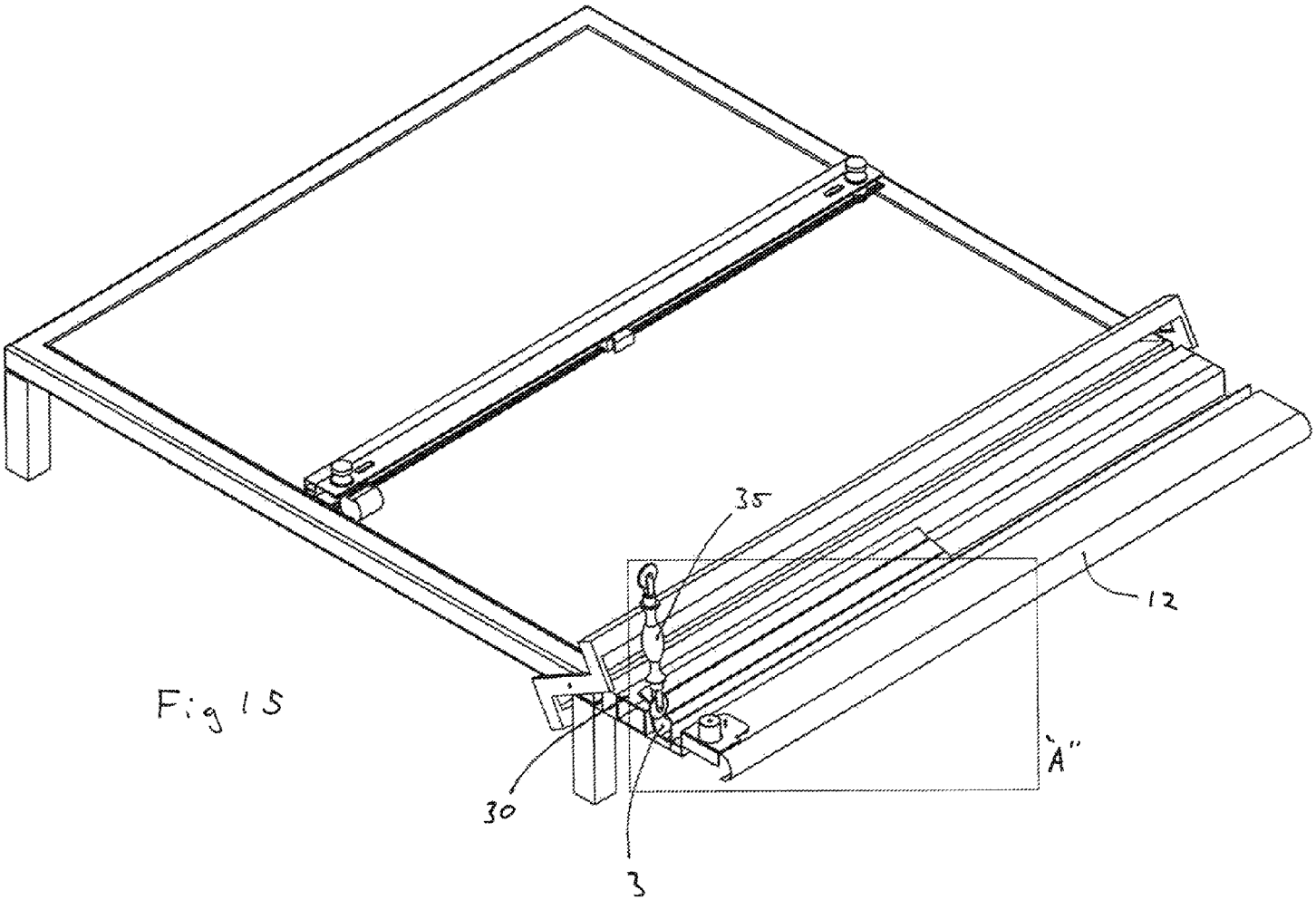
FIG. 15 is an upper side perspective view of the assembly table shown in FIG. 13.
Figure 16:
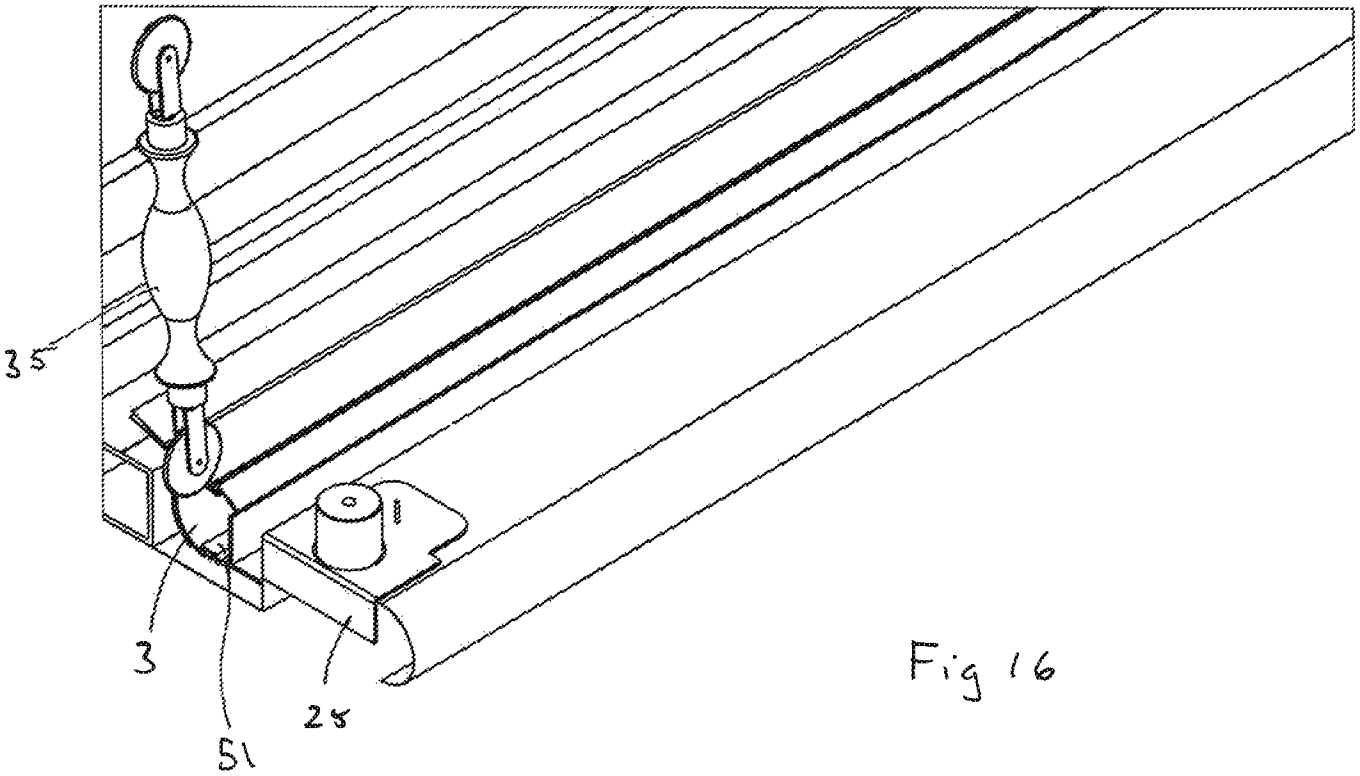
FIG. 16 is an enlarged view of portion "A" shown in FIG. 15.

Turning to FIGS. 11 and 12, assembly table 11 may include a mounting tape holder 25 positioned generally at first end 12. As will be discussed in further detail later, during the assembly of light filtering window shades, mounting tape 26 is typically utilized to secure the top edges of the front and rear panels of the sheer fabric to the roller tube. Mounting tape 26 is commonly a relatively rigid material (for example, polyethylene, polypropylene or a similar material) having an adhesive on one side that allows that tape to be secured to the upper ends of the front and rear panels. To facilitate securing the mounting tape to the front and rear panels, mounting tape holder 25 is positioned at first end 12 of assembly table 11 and includes a pin 27 upon which the mounting tape can be received through inserting pin through a hole in the end of the tape. So doing allows the tape to be held tautly as its adhesive surface is brought into contact with the edge of either the front or rear panel of the shade fabric. In the particular embodiment shown in the attached drawings mounting tape holder 25 is held magnetically upon the surface of assembly table 11, permitting the tape holder to be easily removed when not required.

Figure 10:
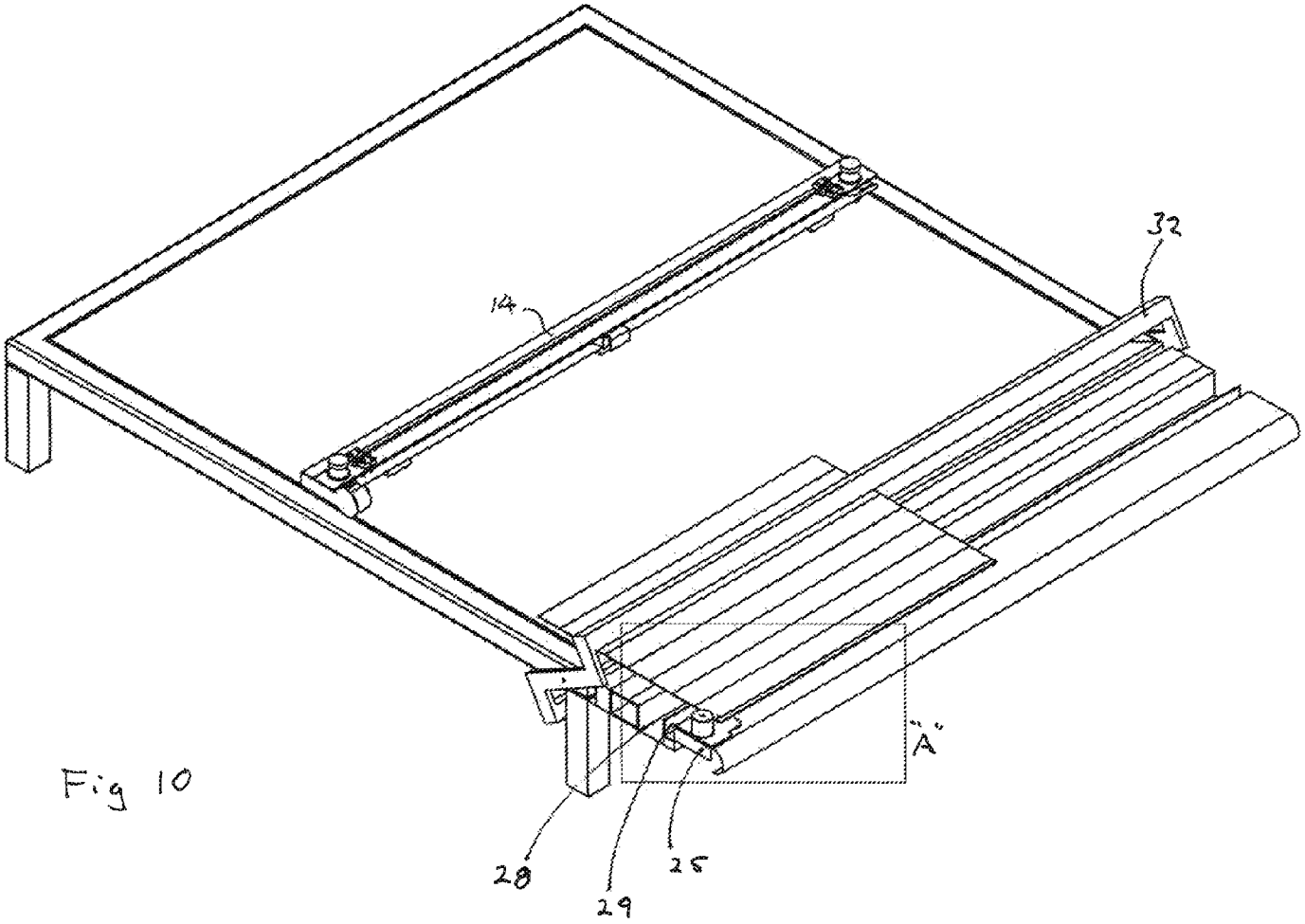
FIG. 10 is an upper side perspective view of the assembly table having positioned thereon fabric for making a light filtering window shade.

FIGS. 10 and 11 serve to illustrate two additional features of first end 12 of assembly table 11. The embodiment shown includes a roller tube channel 28 and a bottom bar holder or channel 29, each of which run laterally across first end 12. Roller tube channel 28 is sized to hold a standard roller tube and retains the tube parallel to first end 12. Channel 28 facilitates the attachment of front and rear panels 8 and 9 of shade fabric 2 to the roller tube, as will be described in further detail below. Bottom bar holder or channel 29 is dimensioned to receive a bottom bar for the light filtering window shade to facilitate the attachment of the bottom bar to the bottom of the front and rear panels of the shade fabric.

First end 12 of assembly table 11 may also include a cutting rail 30, that is again parallel to the end of the table. Cutting rail 30 will also be generally parallel to roller tube positioning rail 14 when the positioning rail is releasably secured to the assembly table, which permits the shade fabric to be cut to a desired length while ensuring that the cut edge of the fabric is generally parallel to the roller tube. Determining the length of the shade fabric and cutting it to its desired length can be achieved through the use of graduations 31 running from cutting rail 30 toward second end 13 of the assembly table.

To further aid in the cutting of the shade fabric, in one embodiment assembly table 11 may include a lateral beam 32 that is rotationally mounted to the table and positioned parallel to cutting rail 30 such that the beam 32 can be rotated in order to contact cutting rail 30. A cutter 33 may be mounted on a track upon the lateral beam, permitting the cutter to be slid across the width of the assembly table, and to thus trim or cut the length the shade fabric as required. The cutter could be a knife cutter, a rotary cutter, an electric shear, etc.

Figure 17:
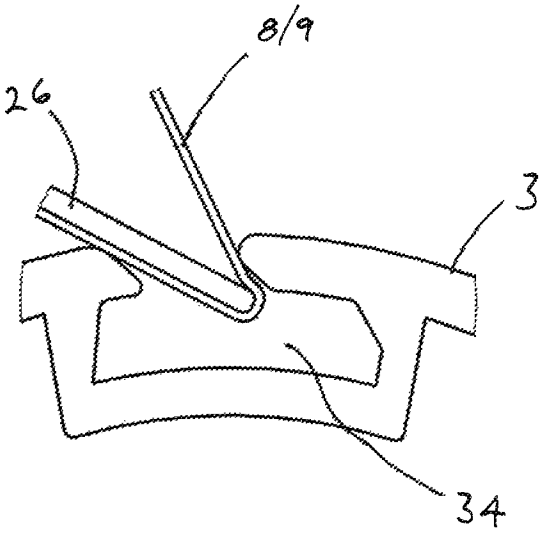
FIG. 17 is an enlarged detail view showing the shade fabric being attached to the shade roller tube.
Figure 18:
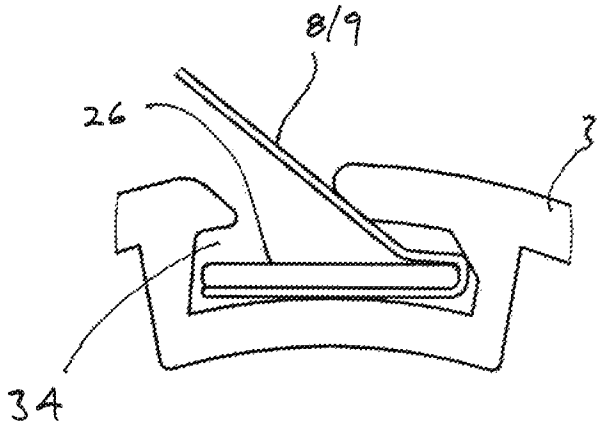
FIG. 18 is an enlarged detail view subsequent to FIG. 17 wherein the shade fabric is attached to the shade roller tube.
Figure 19:
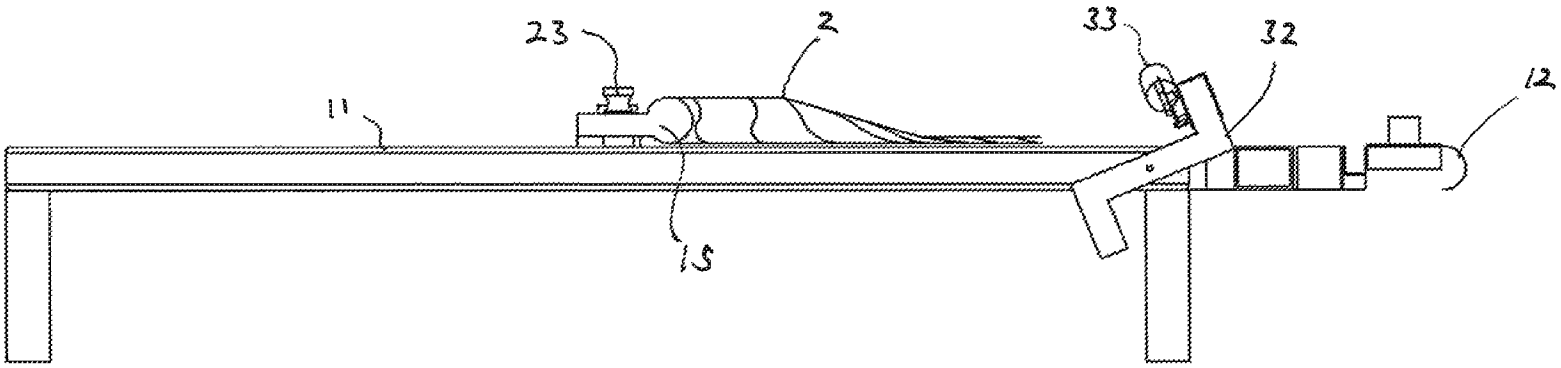
FIG. 19 is a side view of the assembly table wherein the shade's roller tube with the shade fabric attached thereto is secured to the roller tube positioning rail.
Figure 20:
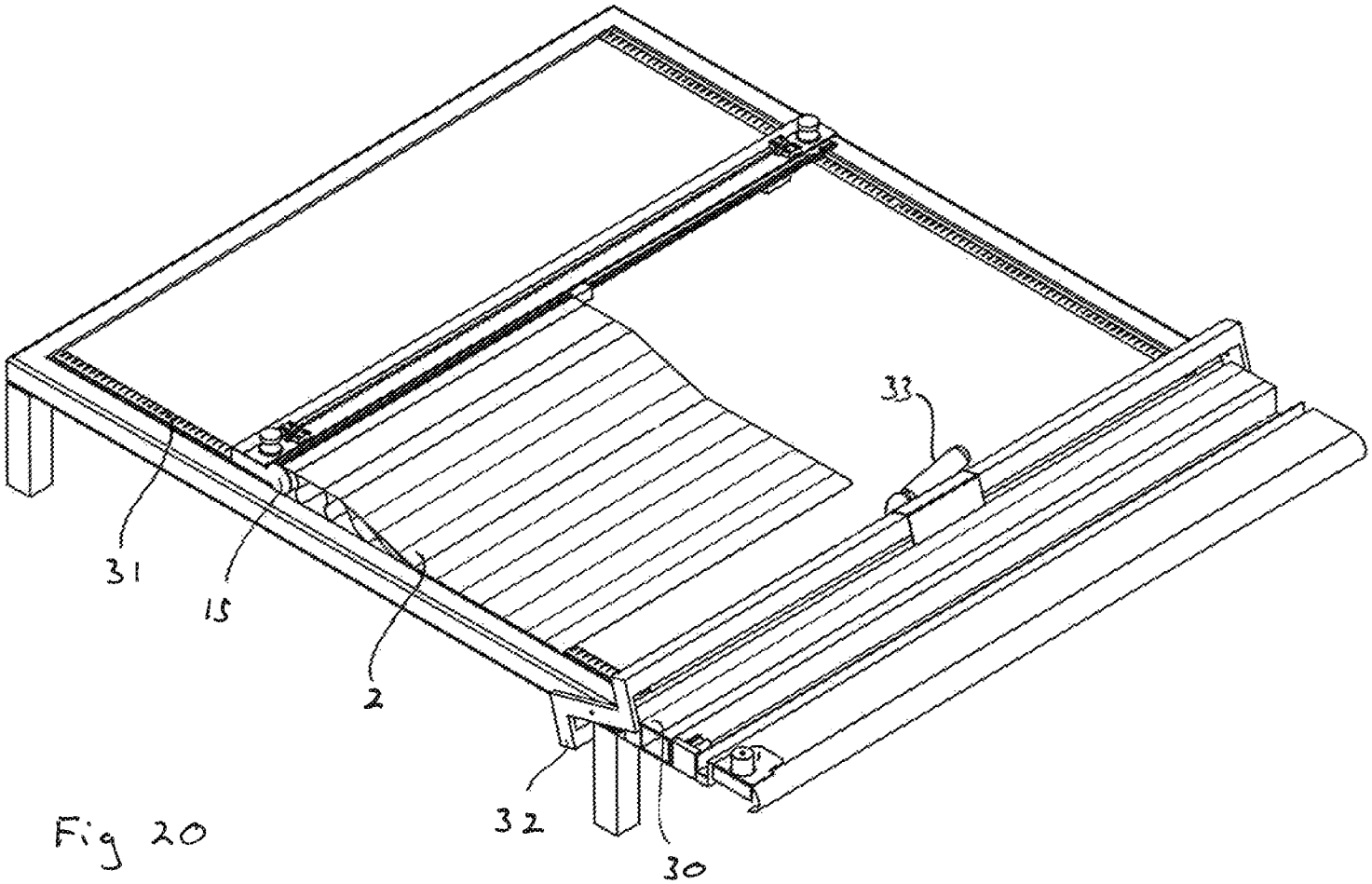
FIG. 20 is an upper side perspective view of the assembly table shown in FIG. 19.
Figure 21:
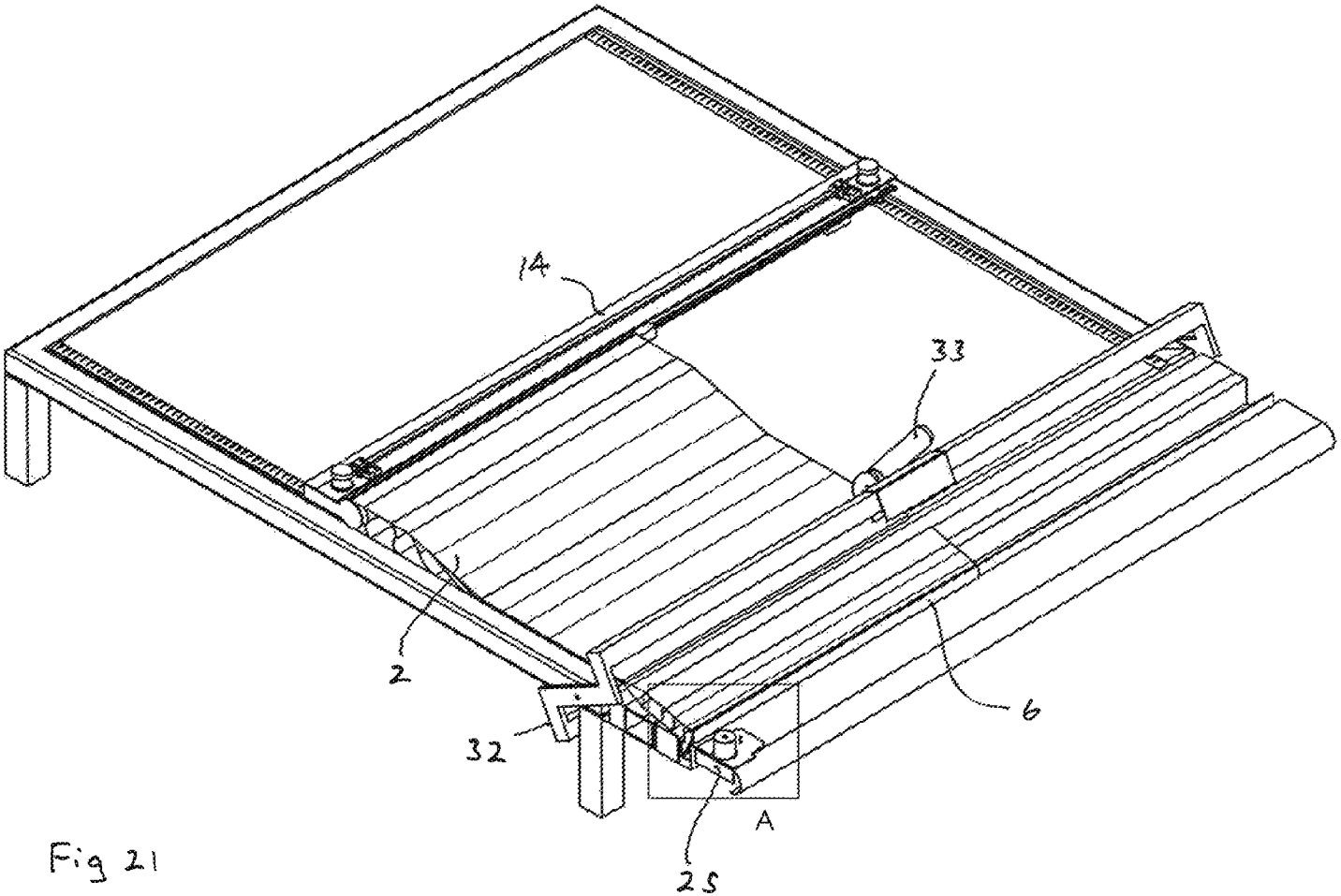
FIG. 21 is a view similar to FIG. 20 wherein the free end of the shade fabric is being inserted into the shade's bottom rail.
Figure 22:
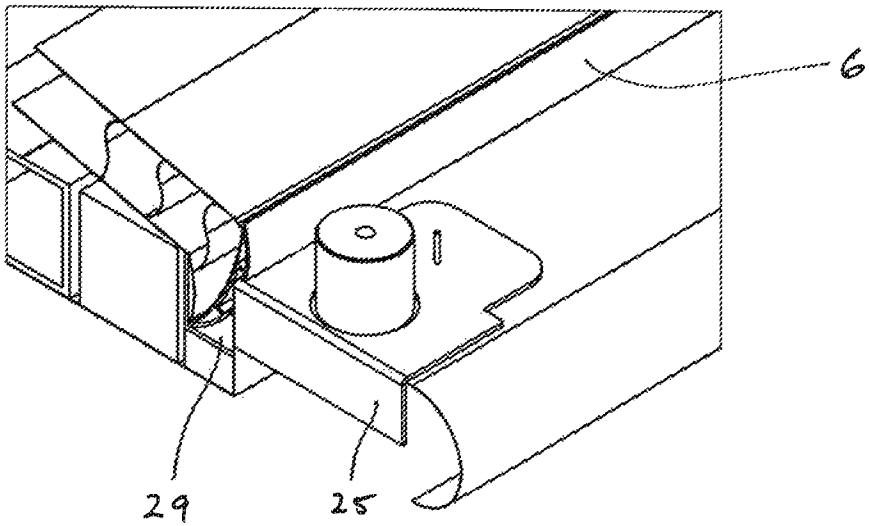
FIG. 22 is an enlarged view of portion "A" shown in FIG. 21.
Figure 23:
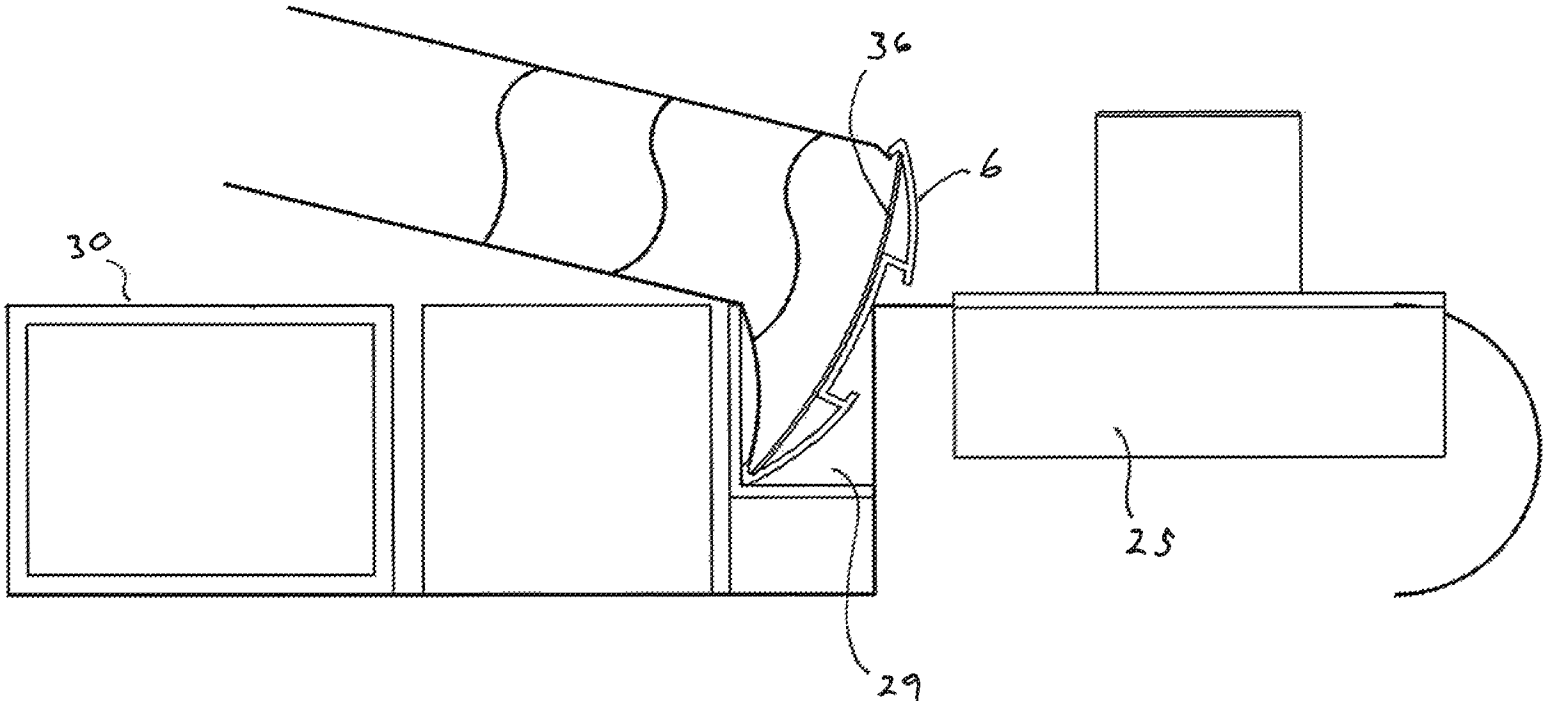
FIG. 23 is a side view of portion "A" shown in FIG. 21.

To more thoroughly describe the structure and function of assembly table 11, reference will now be made to one particular method of utilizing the table during the process of manufacturing a light filtering window shade from shade fabric 2. Typically the first step when assembling the shade will be to utilize cutter 33 to cut a length of shade fabric that is slightly longer than ultimately required. Once the shade fabric has been cut to its approximate size, the next task will be to secure the shade fabric to the roller tube. To that end, mounting tape is first applied to the upper ends of each of the front and rear panels 8 and 9 of the shade fabric. If desired, a hole in one end of the mounting tape can be formed such that the tape can be slid over pin 27 of mounting tape holder 25 to help stretch the tape and hold it taught as it is pushed downwardly into contact with the respective panel of the shade fabric. Doing so can help to ensure that the tape is adhered squarely to the panel and that folding or buckling of the panel is avoided. Once a length of mounting tape has been adhered to each of the front and rear panels of the shade fabric the roller tube can be inserted into roller tube channel 28, as shown more specifically in FIGS. 13 through 18. As is common, roller tube 3 will have opposed longitudinal channels 34 that are dimensioned to receive mounting tape 26 therein in order to secure the front and rear panels of the shade fabric to the roller tube. Inserting the mounting tape and a portion of the front or rear panel into a respective channel 34 on the roller tube may be accomplished through the use of a wheeled hand tool 35 that compresses and "snaps" the tape into channel 34. Once one of the mounting tapes has been inserted into one of the channels 34, the roller tube can merely be rotated about its longitudinal axis to expose the second channel 34, at which time the second mounting tape can be inserted. FIGS. 17 and 18 progressively show the insertion of the mounting tape into channels 34 of the roller tube.

After the shade fabric has been secured to the roller tube, the tube is removed from channel 28 and secured to roller tube positioning rail 14. One such manner of securing the roller tube to the positioning rail has been described above. Either prior to securing the roller tube to positioning rail or immediately thereafter, the positioning rail will be located upon the upper surface of the assembly table at a desired distance from cutting rail 30. Graduations 31 aid in setting the location of rail a proper distance from the cutting rail and from first end 12 of the assembly table. Once properly located, the positioning rail is retained in place by magnets 23.

With the positioning rail and roller tube thusly located, the length of the shade fabric can be trimmed if necessary, after which steps can be taken to attach the bottom bar. Attaching the bottom bar is accomplished through first placing the bottom bar within bottom bar holder or channel 29. The lower end of the shade fabric, having attached thereto a length of bottom bar tape 36 (which will typically be generally similar to mounting tape 26, however, of a wider dimension), is then secured to the bottom bar using traditional methods. After the bottom bar has been attached to bottom bar tape 36, end caps 37 can be installed, the bottom bar removed from holder or channel 29, roller tube 3 removed from roller tube positioning rail 14, and the shade fabric/roller tube/bottom bar sub-assembly then taken to be fitted with end brackets, mounting brackets, a clutch and drive system, etc. in order to complete the assembly of the finished shade product.

From a complete understanding of the above described invention, one of ordinary skill in the art will understand that what has been presented is a new and unique apparatus that aids in the manufacture of light filtering window shades. The apparatus presents the operator with a relatively simplified efficient method for constructing the shade fabric/roller tube/bottom bar sub-assembly. The inherent adjustability of the described apparatus facilitates the manufacture of a large number of identically sized shades, while also allowing the operator to easily adjust the equipment for the production of shades of different sizes.

It is to be understood that what has been described are the preferred embodiments of the invention. The scope of the claims should not be limited by the preferred embodiments set forth above, but should be given the broadest interpretation consistent with the description as a whole.

I claim:

1. An apparatus to aid in the making of a light filtering window shade from shade fabric comprised of a series of longitudinal vane members having their longitudinal edges respectively secured to front and rear fabric panels, the apparatus comprising:

an assembly table, said assembly table having first and second ends with said first end adapted to facilitate the cutting of the shade fabric to a desired length, and a roller tube positioning rail releasably securable to the assembly table, said positioning rail releasably receiving a roller tube having one end of the shade fabric secured thereto, said positioning rail permitting the roller tube, and the shade fabric secured thereto, to be set-off a predetermined distance from said first end of said assembly table, said positioning rail maintaining the roller tube generally parallel to said first end of said assembly table, said roller tube positioning rail including a first roller tube clamp and a second roller tube clamp, said first and second roller tube clamps engaging the roller tube and releasably securing the roller tube to said positioning rail, the position of at least one of said roller tube clamps adjustable along the length of said positioning rail to permit roller tubes of varying lengths to be releasably secured to said positioning rail.

2. The apparatus as claimed in claim 1 wherein said roller tube positioning rail prevents the rotation of the roller tube about its longitudinal axis when the roller tube is releasably secured to said positioning rail.

3. The apparatus as claimed in claim 2 wherein said roller tube positioning rail is magnetically securable to said assembly table.

4. The apparatus as claimed in claim 1 wherein said first end of said assembly table includes a bottom bar holder said bottom bar holder releasably receiving a bottom bar for a light filtering window shade to facilitate the attachment of shade fabric thereto.

5. The apparatus as claimed in claim 1 wherein said first end of said assembly table includes a cutting rail, said cutting rail positioned generally parallel to said roller tube positioning rail when said positioning rail is releasably secured to said assembly table, said cutting rail permitting shade fabric attached to a roller tube releasably secured to said roller tube positioning rail to be cut to a desired length such that the cut edge of the fabric is generally parallel to the roller tube.

6. The apparatus as claimed in claim 5 wherein said assembly table includes graduations extending from said first end toward said second end to facilitate the cutting of shade fabric to a predetermined length.

7. The apparatus as claimed in claim 5 wherein said assembly table includes a lateral beam, said lateral beam positioned parallel to said cutting rail and rotationally mounted to said table, said lateral beam including a cutter to facilitate cutting the shade fabric.

8. The apparatus as claimed in claim 1 wherein the upper surface of said assembly table is generally horizontal.

9. An apparatus to aid in the making of a light filtering window shade from shade fabric comprised of a series of longitudinal vane members having their longitudinal edges respectively secured to front and rear fabric panels, the apparatus comprising:

an assembly table, said assembly table having first and second ends with said first end adapted to facilitate the cutting of the shade fabric to a desired length;

a roller tube positioning rail releasably securable to the assembly table, said positioning rail releasably receiving a roller tube having one end of the shade fabric secured thereto, said positioning rail permitting the roller tube, and the shade fabric secured thereto, to be set-off a predetermined distance from said first end of said assembly table, said positioning rail maintaining the roller tube generally parallel to said first end of said assembly table, said roller tube positioning rail including a first roller tube clamp and a second roller tube clamp, said first and second roller tube clamps engaging the roller tube and releasably securing the roller tube to said positioning rail; and a cutting rail positioned at said first end of said assembly table, said cutting rail positioned generally parallel to said roller tube positioning rail when said positioning rail is releasably secured to said assembly table, said cutting rail permitting shade fabric attached to a roller tube releasably secured to said roller tube positioning rail to be cut to a desired length such that the cut edge of the fabric is generally parallel to the roller tube.

* * * * *